US010364733B2

(12) United States Patent
Amano

(10) Patent No.: US 10,364,733 B2
(45) Date of Patent: Jul. 30, 2019

(54) INTERNAL COMBUSTION ENGINE

(71) Applicant: TOYOTA JIDOSHA KABUSHIKI KAISHA, Toyota-shi, Aichi-ken (JP)

(72) Inventor: Takashi Amano, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 35 days.

(21) Appl. No.: 15/729,893

(22) Filed: Oct. 11, 2017

(65) Prior Publication Data

US 2018/0149068 A1 May 31, 2018

(30) Foreign Application Priority Data

Nov. 30, 2016 (JP) ..... 2016-232762

(51) Int. Cl.

| | |
|---|---|
| ***F01N 13/10*** | (2010.01) |
| ***F02B 75/18*** | (2006.01) |
| ***F01N 3/10*** | (2006.01) |
| ***F01N 13/14*** | (2010.01) |

(52) U.S. Cl.

CPC ..... *F01N 13/102* (2013.01); *F01N 3/10* (2013.01); *F01N 13/107* (2013.01); *F01N 13/141* (2013.01); *F02B 75/18* (2013.01); *F01N 2470/14* (2013.01)

(58) Field of Classification Search

CPC ..... F01N 3/043; F01N 3/046; F01N 13/102; F01N 13/141; F01N 13/143; F01N 13/145; F01N 13/146; F01N 2470/14; F01F 1/243

See application file for complete search history.

(56) References Cited

U.S. PATENT DOCUMENTS

| | | | | |
|---|---|---|---|---|
| 6,427,440 | B1 * | 8/2002 | Bonny | F01N 13/102 60/321 |
| 2009/0151343 | A1 * | 6/2009 | Son | F01N 13/10 60/323 |
| 2017/0016377 | A1 | 1/2017 | Jinda et al. | |

FOREIGN PATENT DOCUMENTS

| | | |
|---|---|---|
| JP | H06299887 A | 10/1994 |
| JP | H08127847 A | 5/1996 |
| JP | H09296722 A | 11/1997 |
| JP | 10-37746 | 2/1998 |
| WO | WO 2015/15217 A1 | 10/2015 |

* cited by examiner

*Primary Examiner* — Jonathan R Matthias

(74) *Attorney, Agent, or Firm* — Finnegan, Henderson, Farabow, Garrett & Dunner, LLP

(57) ABSTRACT

An internal combustion engine includes a manifold channel. With respect to a longest cylinder that is a cylinder whose flow channel length from the cylinder to a collective portion is the longest among three cylinders, the manifold channel is provided with a hollow layer that covers a part of a channel wall in the flow channel direction of a branch channel connected to the longest cylinder. With respect to a shortest cylinder that is a cylinder whose flow channel length from the cylinder to the collective portion are the shortest, the manifold channel is not provided with a hollow layer that covers a channel wall of a branch channel connected to the shortest cylinder. A wall that forms the hollow layer for the longest cylinder is formed integrally and continuously with the same material as a channel wall of the branch channel connected to the longest cylinder.

16 Claims, 9 Drawing Sheets

INTERNAL COMBUSTION ENGINE

CROSS-REFERENCE TO RELATED APPLICATION

This application is based on and claims the benefit of Japanese Patent Application No. 2016-232762, filed on Nov. 30, 2016, which is incorporated by reference herein in its entirety.

BACKGROUND

Technical Field

The present disclosure relates to an internal combustion engine that includes a manifold channel that collects, into one, exhaust gases from a plurality of cylinders and a catalytic device that is arranged on the downstream side of this manifold channel.

Background Art

JP 10-037746 A discloses an exhaust pipe having a double-pipe structure in order to reduce the heat released from exhaust gas to the exhaust pipe. This exhaust pipe (more specifically, an exhaust manifold) is provided with an inner pipe through which the exhaust gas flows and an outer pipe that forms a hollow layer with the inner pipe. The inner pipe is formed by combining a pair of half bodies that are formed by press molding. The outer pipe is formed by combining a pair of half bodies that are formed by press molding in such a manner that the inner pipe is sandwiched in between this pair of half bodies. To be more specific, in a manner such that a flange portion of the pair of half bodies of the inner pipe is sandwiched in between a flange portion of the pair of half bodies of outer pipe, these flange portions are welded together.

JP 10-037746 A is a patent document which may be related to the present disclosure.

SUMMARY

An internal combustion engine is known that includes a manifold channel where exhaust gases from a plurality of cylinders are collected into one and a catalytic device that is arranged on the downstream side of the manifold channel. In the internal combustion engine having this kind of configuration, the flow channel lengths of a plurality of branch channels of the manifold channel may be different from each other between cylinders. When the length of one of the branch channels is longer, a zone where heat exchange is conducted between exhaust gas and the wall of the branch channel while the exhaust gas flows in the branch channel becomes longer. Therefore, when the branch channel is longer, the amount of temperature decrease of the exhaust gas occurred as a result of the exhaust gas flowing through the branch channel becomes greater than that when the branch channel is shorter. As a result, the temperature of the exhaust gas that flows into a collective portion from a relatively long branch channel becomes lower than the temperature of the exhaust gas that flows into the collective portion from a relatively short branch channel. Thus, if the temperature of the exhaust gas that flows into the collective portion from the relatively short branch channel is used as a reference, when an exhaust gas whose temperature has decreased more largely flows into the collective portion from a branch channel, the temperature of the exhaust gases that have been collected at the collective portion may decrease. This leads to a decrease in temperature of the exhaust gas that flows into the catalytic device. As just described, the presence of a large temperature decrease in the relatively long branch channel is not favorable in terms of attaining a rapid activation of a catalyst of the catalytic device and of maintaining its activation state properly.

In the exhaust pipe having a double-pipe structure disclosed in JP 10-037746 A, all the branch channels of the exhaust manifold corresponding to a pipe that forms the manifold channel is covered in whole by the hollow layer. This kind of structure can increase the temperature of the exhaust gases supplied to the collective portion from all the branch channels. This is effective in terms of attaining a rapid activation of the catalyst and of maintaining its activation state properly. However, if all the branch channels is covered in whole by the hollow layer, there is a concern that the catalyst may become likely to be overheated during a high-load operation of the internal combustion engine. Based on the above, it is favorable that in order to attain a rapid activation of the catalyst and to maintain its activation state properly, the structure of the manifold channel for an exhaust system is determined while also properly taking into consideration a reduction of overheat of the catalyst during a high-load operation.

The present disclosure has been made to address the problem described above, and an object of the present disclosure is to provide an internal combustion engine that can improve the heat retaining property of a manifold channel for an exhaust system to attain a rapid activation of a catalyst and to maintain its activation state properly, while taking into consideration a reduction of overheat of the catalyst during a high-load operation of the internal combustion engine.

An internal combustion engine according to a first aspect of the present disclosure includes: an exhaust channel that includes a manifold channel including a plurality of branch channels that are respectively connected to a plurality of cylinders and a collective portion where exhaust gases flowing through the plurality of branch channels are collected into one, and a common channel arranged on a downstream side of the collective portion; and a catalytic device that is arranged in the common channel and configured to purify the exhaust gases.

With respect to a longest cylinder that is a cylinder whose flow channel length from the cylinder to the collective portion is the longest among the plurality of cylinders, the manifold channel includes a first hollow layer that covers a part or a whole of a channel wall in a first flow channel direction of a corresponding branch channel that is connected to the longest cylinder.

With respect to a shortest cylinder that is a cylinder whose flow channel length from the cylinder to the collective portion is the shortest among the plurality of cylinders and other than the longest cylinder, the manifold channel does not include a second hollow layer that covers a corresponding branch channel that is connected to the shortest cylinder.

A wall that forms the first hollow layer is formed integrally and continuously with a same material as the channel wall of the branch channel that is connected to the longest cylinder.

An internal combustion engine according to a second aspect of the present disclosure includes: an exhaust channel that includes a manifold channel including a plurality of branch channels that are respectively connected to a plurality of cylinders and a collective portion where exhaust gases flowing through the plurality of branch channels are collected into one, and a common channel arranged on a downstream side of the collective portion; and a catalytic device that is arranged in the common channel and configured to purify the exhaust gases.

With respect to a longest cylinder that is a cylinder whose flow channel length from the cylinder to the collective portion is the longest among the plurality of cylinders, the manifold channel includes a first hollow layer that covers a part or a whole of a channel wall in a first flow channel direction of a corresponding branch channel that is connected to the longest cylinder.

With respect to a shortest cylinder that is a cylinder whose flow channel length from the cylinder to the collective portion is the shortest among the plurality of cylinders and other than the longest cylinder, the manifold channel includes a second hollow layer which covers a part of a channel wall in a second flow channel direction of a corresponding branch channel that is connected to the shortest cylinder and whose length in the second flow channel direction is shorter than that of the first hollow layer in the first flow channel direction.

A wall that forms the first hollow layer is formed integrally and continuously with a same material as the channel wall of the branch channel that is connected to the longest cylinder, and a wall that forms the second hollow layer is formed integrally and continuously with a same material with the channel wall of the branch channel that is connected to the shortest cylinder.

The plurality of cylinders may include, other than the longest cylinder and the shortest cylinder, an intermediate cylinder that is a cylinder whose flow channel length to the collective portion is shorter than that of the longest cylinder and longer than that of the shortest cylinder.

The manifold channel may include a third hollow layer which covers a part of a channel wall in a third flow channel direction of a corresponding branch channel that is connected to the intermediate cylinder, and whose length in the third flow channel direction is shorter than that of the first hollow layer in the first flow channel direction.

A wall that forms the third hollow layer may be formed integrally and continuously with a same material as the channel wall of the branch channel that is connected to the intermediate cylinder.

The plurality of cylinders may include, other than the longest cylinder and the shortest cylinder, an intermediate cylinder that is a cylinder whose flow channel length to the collective portion is shorter than that of the longest cylinder and longer than that of the shortest cylinder.

The manifold channel may include a third hollow layer which covers a part of a channel wall in a third flow channel direction of a corresponding branch channel that is connected to the intermediate cylinder and whose length in the third flow channel direction is shorter than that of the first hollow layer in the first flow channel direction and longer than that of the second hollow layer in the second flow channel direction.

A wall that forms the third hollow layer may be formed integrally and continuously with a same material as the channel wall of the branch channel that is connected to the intermediate cylinder.

The intermediate cylinder may include a plurality of intermediate cylinders whose flow channel lengths to the collective portion are different from each other.

The third hollow layer may include a plurality of third hollow layers that are respectively provided for the branch channels corresponding to the plurality of intermediate cylinder.

Lengths of the plurality of third hollow layers in the third flow channel direction may be longer in the third hollow layer corresponding to the intermediate cylinder whose flow channel length to the collective portion is longer, than in the third hollow layer corresponding to the intermediate cylinder whose flow channel length to the collective portion is shorter.

The first hollow layer may cover a straight portion or a substantially straight portion of the channel wall of the branch channel that is connected to the longest cylinder.

The second hollow layer may cover a straight portion or a substantially straight portion of the channel wall of the branch channel that is connected to the shortest cylinder.

The third hollow layer may cover a straight portion or a substantially straight portion of the channel wall of the branch channel that is connected to the intermediate cylinder.

An internal combustion engine according to a third aspect of the present disclosure includes: a cylinder head; an exhaust channel that includes a manifold channel through which exhaust gases from a first cylinder group and a second cylinder group flow, and a common channel arranged on a downstream side of the manifold channel; and a catalytic device that is arranged in the common channel and configured to purify the exhaust gases.

The manifold channel includes: a first primary manifold channel that is connected to the first cylinder group and that includes a first primary collective portion where the exhaust gases from the first cylinder group are collected into one; a second primary manifold channel that is connected to the second cylinder group and that includes a second primary collective portion where the exhaust gases from the second cylinder group are collected into one; and a secondary manifold channel that includes a first common branch channel connected to the first primary collective portion, a second common branch channel connected to the second primary collective portion and a secondary collective portion where the first common branch channel and the second common branch channel are joined with each other.

The first common branch channel includes a first outer common branch channel that is arranged outside the cylinder head and that is connected to the second collective portion.

The second common branch channel includes a second outer common branch channel that is arranged outside the cylinder head and that is connected to the second collective portion.

The first outer common branch channel is longer than the second outer common branch channel.

The manifold channel includes a fourth hollow layer which covers a part or a whole of a channel wall in a fourth flow channel direction of the first outer common branch channel, and does not include a five hollow layer that covers the second outer common branch channel.

A wall that forms the fourth hollow layer is formed integrally and continuously with a same material as the channel wall of the first outer common branch channel.

An internal combustion engine according to a fourth aspect of the present disclosure includes: a cylinder head; an exhaust channel that includes a manifold channel through which exhaust gases from a first cylinder group and a second cylinder group flow, and a common channel arranged on a downstream side of the manifold channel; and a catalytic device that is arranged in the common channel and configured to purify the exhaust gases.

The manifold channel includes: a first primary manifold channel that is connected to the first cylinder group and that includes a first primary collective portion where the exhaust gases from the first cylinder group are collected into one; a second primary manifold channel that is connected to the second cylinder group and that includes a second primary collective portion where the exhaust gases from the second cylinder group are collected into one; and a secondary manifold channel that includes a first common branch channel connected to the first primary collective portion, a second common branch channel connected to the second primary collective portion and a secondary collective portion where the first common branch channel and the second common branch channel are joined with each other.

The first common branch channel includes a first miter common branch channel that is arranged outside the cylinder head and that is connected to the second collective portion.

The second common branch channel includes a second outer common branch channel that is arranged outside the cylinder head and that is connected to the second collective portion.

The first outer common branch channel is longer than the second outer common branch channel.

The manifold channel includes: a fourth hollow layer which covers a part or a whole of a channel wall in a fourth flow channel direction of the first outer common branch channel, and a fifth hollow layer which covers a part of a channel wall in a fifth flow channel direction of the second outer common branch channel, and whose length in the fifth flow channel direction is shorter than that of the fourth hollow layer in the fourth flow channel direction.

A wall that forms the fourth hollow layer is formed integrally and continuously with a same material as the channel wall of the first outer common branch channel, and a wall that forms the fifth hollow layer is formed integrally and continuously with a same material as the channel wall of the second outer common branch channel.

The fourth hollow layer may cover a straight portion or a substantially straight portion of the channel wall of the first outer common branch channel.

The fifth hollow layer may cover a straight portion or a substantially straight portion of the channel wall of the second outer common branch channel.

According to the internal combustion engine of each of the first to fourth aspects of the present disclosure, a hollow layer is provided so as to cover a part of channel walls of a manifold channel (including common branch channel) on the upstream side of a collective portion (including secondary collective portion) where exhaust gases are collected into one. Also, of the branch channels, a relatively long branch channel is given priority for providing the hollow layer. As a result, a decrease in temperature of exhaust gas occurred as a result of the exhaust gas flowing through the relatively long branch channel can be reduced. Therefore, a rapid activation of a catalyst of the catalytic device and a proper maintenance of its activation state can be achieved more easily as compared with an example in which the manifold channel does not include a hollow layer at all. Furthermore, according to the internal combustion engine of each of the first to fourth aspects of the present disclosure, the hollow layer is not provided in such a manner as to wholly cover all the branch channels of the manifold channel. Therefore, the temperature management of the catalyst can be performed more properly while taking into consideration a good balance between securement of activation of the catalyst and reduction of overheat of the catalyst during a high-load operation, in contrast to an example in which all branch channels of a manifold channel are covered in whole by a hollow layer.

DETAILED DESCRIPTION

In the following, embodiments of the present disclosure are described with reference to the accompanying drawings. However, it is to be understood that even when the number, quantity, amount, range or other numerical attribute of an element is mentioned in the following description of the embodiments, the present disclosure is not limited to the mentioned numerical attribute unless explicitly described otherwise, or unless the present disclosure is explicitly specified by the numerical attribute theoretically. Further, structures or the like that are described in conjunction with the following embodiments are not necessarily essential to the present disclosure unless explicitly shown otherwise, or unless the present disclosure is explicitly specified by the structures or the like theoretically.

First Embodiment

Figure 1:
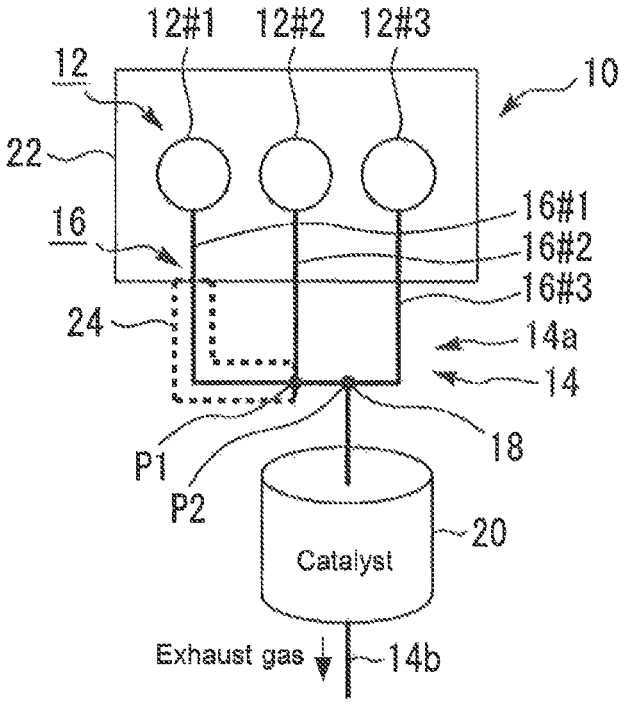
FIG. 1 is a schematic diagram that illustrates a configuration of an internal combustion engine according to a first embodiment of the present disclosure.

FIG. 1 is a schematic diagram that illustrates a configuration of an internal combustion engine 10 according to the first embodiment of the present disclosure. The internal combustion engine 10 shown in FIG. 1 is an in-line three-cylinder engine that includes three cylinders 12#1, 12#2 and 12#3. The internal combustion engine 10 is provided with an exhaust channel 14 through which exhaust gases from these cylinders 12 flow. In the following description, if there is no need to distinguish the cylinders 12#1 to 12#3 from each other, they may be simply referred to as "cylinders 12". In addition, with respect to not only the cylinders 12 but also other components, reference numerals may be similarly abbreviated in this manner.

The exhaust channel 14 is provided with a manifold channel **14*a* and a common channel 14*b*. The manifold channel 14*a* is provided with three branch channels 16#1, 16#2 and 16#3 connected to the respective three cylinders 12, and a collective portion 18 where the exhaust gases flowing through these branch channels 16 (that is, all the branch channels 16) are collected into one. A portion of the exhaust channel 14 on the downstream side of the collective portion 18 corresponds to the common channel 14*b*. In the common channel 14*b*, a catalytic device 20 that purifies the exhaust gases (for example, a device including a three-way catalyst) is arranged. In addition, in FIG. 1, the exhaust channel 14 is schematically represented by a flow-channel center line. The length of the flow-channel center line corresponds to the flow channel length of the exhaust channel 14**.

To be more specific, the manifold channel **14*a* corresponds to flow channels in exhaust ports (not shown) that are formed in the cylinder head 22 for the respective cylinders 12, and flow channels in an exhaust manifold (not shown) connected to the cylinder head 22. The branch channel 16#1 is a portion of the manifold channel 14*a* located from a connecting position (that is, an intake port end on the side of the cylinder 12#1) with the cylinder 12#1 (more specifically, combustion chamber) to the collective portion 18. Similarly, the branch channel 16#2 is a portion located from a connecting position with the cylinder 12#2 to the collective portion 18, and the branch channel 16#3 is a portion located from a connecting position with the cylinder 12#3 to the collective portion 18**.

In the example of the manifold channel **14*a* shown in FIG. 1, after the exhaust gases from two cylinders 12#1 and 12#2 are collected at a position P1 on the upstream side of the collective portion 18, the exhaust gases from all the cylinders 12 are collected into one at a position P2 of the collective portion 18. Thus, in this example, a zone from the position P1 to the position P2 corresponds to not only a part of the branch channel 16#1 but also a part of the branch channel 16#2. That is, in this example, there is a common branch channel for a subset of branch channels (16#1 and 16#2**).

In the example of the manifold channel **14*a* shown in FIG. 1, with respect to the flow channel length from each of the cylinders 12 to the collective portion 18, the flow channel length from the cylinder 12#1 is the longest, and the flow channel length from the cylinder 12#2 is the same as that from the cylinder 12#3 and the both are shorter than that from the cylinder 12#1. Thus, the cylinder 12#1 corresponds to a "longest cylinder" according to the present disclosure, and each of the cylinders 12#2 and 12#3** corresponds to a "shortest cylinder" according to the present disclosure. In addition, in this example, although the number of the longest cylinder is one, it may be plural depending on the configuration of the manifold channel.

Figure 2:
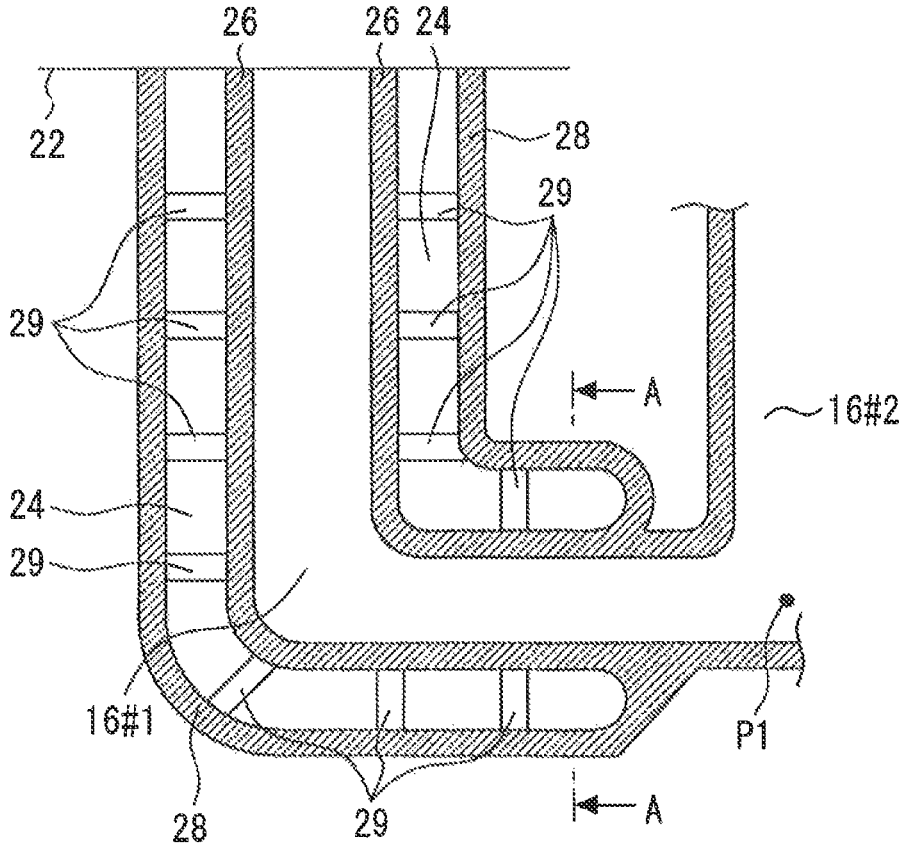
FIG. 2 is an enlarged diagram that illustrates a configuration around a hollow layer 24 shown in FIG. 1.

The manifold channel **14*a* is provided with a hollow layer 24. In FIG. 1, an area surrounded by a broken line corresponds to a formation range in which the hollow layer 24 is formed. FIG. 2 is an enlarged diagram that illustrates a configuration around the hollow layer 24 shown in FIG. 1. As shown in FIG. 2, the hollow layer 24 covers a part of a flow channel wall 26 in a low channel direction (which corresponds to a "first flow channel direction" according to the present disclosure) of the branch channel 16#1 that is connected to the cylinder 12#1 that corresponds to the longest cylinder. In more detail, in the example shown in FIG. 2, the hollow layer 24 is provided so as to cover the branch channel 16#1 in a range from a connecting position between the cylinder head 22 and the exhaust manifold to the vicinity of the position P1 (that is, a connecting position between the branch channel 16#1 and the branch channel 16#2). Also, as shown in FIG. 2, the hollow layer 24 is formed so as not to change the flow channel cross-sectional area of the branch channel 16#1**. In addition, in the following description, it is assumed that the phrase "the length of the hollow layer" means the length in the flow channel direction of the branch channel that is covered by the hollow layer.

Figure 3:
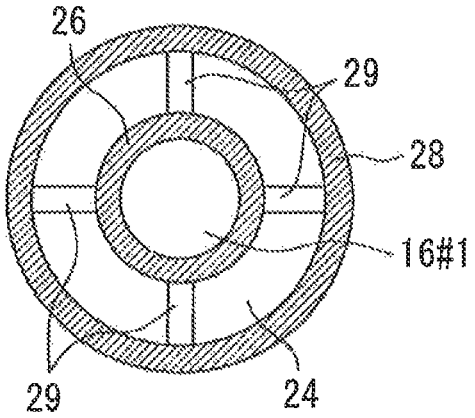
FIG. 3 is a cross-sectional view of a configuration around the hollow layer taken along the line A-A in FIG. 2.

FIG. 3 is a cross-sectional view of a configuration around the hollow layer 24 taken along the line A-A in FIG. 2. As shown in FIG. 3, the cross-sectional shape of the branch channel 16#1 is a circle shape as an example, and the cross-sectional shape of the hollow layer 24 that covers the branch channel 16#1 is a circular ring shape concentric to the cross-sectional shape of the branch channel 16#1. The exhaust manifold that forms the manifold channel **14*a* having this kind of hollow layer 24 can be formed by means of a three-dimensional modeling device, for example. In the present embodiment, a wall 28 that forms the hollow layer 24 (more specifically, an outer wall of the hollow layer 24) does not include a junction between the branch channel 16#1 and the channel wall 26, and is formed integrally and continuously with the same material (basically, a metal material) as the channel wall 26. Similarly to the channel wall 26 and the wall 28 of the hollow layer 24, a flow channel wall of a branch channel and a wall of a hollow layer that covers the flow channel wall in the following other examples according to the present disclosure are formed integrally and continuously with the same material. In addition, the hollow layer 24** is a gas layer as an example (this also applies to other hollow layers described later).

On the other hand, in the present embodiment, with respect to each of the cylinders 12#2 and 12#3 that corresponds to the shortest cylinder, the manifold channel **14*a* does not include a hollow layer that covers the branch channels 16#2 and 16#3 that are respectively connected to these cylinders 12#2 and 12#3. That is, in the manifold channel 14*a*, the hollow layer 24 is provided only for the branch channel 16#1 that corresponds to the longest cylinder 12#1. Thus, in the present embodiment, the hollow layer 24 is provided for not the whole but a part of (all the branch channels 16 of) the manifold channel 14*a***.

As one example, the formation range of the hollow layer 24, which has been described with reference to FIG. 2, is determined on the basis of the following concept. More specifically, if the hollow layer 24 is provided, heat released to the outside from the exhaust gas flowing through the branch channel 16#1 can be reduced more effectively as compared with a configuration that does not include a hollow part. Because of this, a decrease in temperature of the exhaust gas can be reduced when it flows through the branch channel 16#1. The formation range described above (that is, the length of the hollow layer 24 in the flow channel direction of the branch channel 16#1) is determined so as to cause the temperature of the exhaust gas that flows into the collective portion 18 from the branch channel 16#1 to approach the temperature of the exhaust gases that flow into the collective portion 18 from the other branch channels 16#2 and 16#3 for which the hollow layers 24 are not provided (in other words, so as to increase the temperature of the exhaust gas that flows into the collective portion 18 from the branch channel 16#1 to a level that is similar to the temperature of the exhaust gases from the other branch channels 16#2 and 16#3).

Furthermore, as shown in FIGS. 2 and 3, in the hollow layer 24, a plurality of support columns 29 that connect the channel wall 26 of the branch channel 16#1 and the wall (outer wall) 28 of the hollow layer 24 are formed. The plurality of support columns 29 are formed at a predetermined interval in the flow channel direction of the branch channel 16#1 as shown in FIG. 2, and are also formed at a predetermined interval (as an example, 90 degrees) in the circumferential direction of the cross section of the branch channel 16#1 as shown in FIG. 3. The plurality of support columns 29 that bridge the channel wall 26 and the wall 28 of the hollow layer 24 are provided in the hollow layer 24 in this manner, whereby the strength of the manifold channel 14*a* having a hollow structure can be enhanced. With the use of three-dimensional modeling device, the plurality of support columns 29 can be easily manufactured at arbitrary locations in the hollow layer 24. In addition, an installation interval of the support columns 29 in the flow channel direction of the branch channel 16#1 may be determined in such a manner that each of the support columns 29 is located at the resonance point of the channel wall 26 due to a longitudinal wave in the exhaust gas in the branch channel 16#1.

As described so far, according to the manifold channel 14*a* of the present embodiment, the hollow layer 24 having the configuration described above is provided with respect to the branch channel 16#1 that is connected to the cylinder 12#1 in which the flow channel length from each cylinder 12 to the collective portion 18 is the longest. On the other hand, similar hollow layers are not provided for the branch channels 16#2 and 16#3 that are connected to the cylinders 12#2 and 12#3 in which the flow channel length described above becomes the shortest. As already described, since the flow channel length of the branch channel 16#1 is relatively long, the branch channel 16#1 is likely to relatively decrease the temperature of the exhaust gas that flows into the collective portion 18. The hollow layer 24 is provided for the branch channel 16#1, whereby when the exhaust gas flows through the branch channel 16#1, a decrease in temperature of the exhaust gas can be reduced. Therefore, a rapid activation of the catalyst of the catalytic device 20 and a proper maintenance of its activation state can be achieved more easily as compared with an example in which the manifold channel 14*a* does not include a hollow layer, such the hollow layer 24, at all. Moreover, according to the present embodiment, the hollow layer 24 is not provided in such a manner as to wholly cover all the branch channels 16 of the manifold channel 14*a*. Therefore, the temperature management of the catalyst can be performed more properly while taking into consideration a good balance between securement of activation of the catalyst and reduction of overheat of the catalyst during a high-load operation, in contrast to an example in which all branch channels of a manifold channel are covered in whole by a hollow layer.

Moreover, the formation range of the hollow layer 24 is determined on the basis of the concept described above. Thus, the temperature of the exhaust gas that flows into the collective portion 18 from the cylinder 12#1 can be caused to approach the temperature of the exhaust gases that flow into the collective portion 18 from the other cylinders 12#2 and 12#3. In other words, a variation in temperature of the exhaust gases that are collected from the respective cylinders 12 at the collective portion 18 can be reduced. In more detail, the temperature of the exhaust gases from the respective cylinders 12 that are collected into one at the collective portion 18 can be prevented from decreasing from a value equivalent to the temperature of the exhaust gases from the shortest cylinders 12#2 and 12#3 due to the presence of the exhaust gas from the cylinder 12#1 that is relatively long with respect to the flow channel length.

In further addition to the above, according to the modeling by the three-dimensional modeling device, if the formation range of the hollow layer 24 is enlarged, the material cost increases, and the manufacturing time increases and, with this, the energy required to manufacture the hollow layer 24 also increases. As a result, the manufacturing cost of the manifold channel 14*a* increases. According to the present embodiment, the hollow layer is provided at only a part of the manifold channel 14*a* (that is, the hollow layer is provided as the hollow layer 24 that is located around the branch channel 16#1 that is highly required to have the hollow layer compared with other branch channels 16#2 and 16#3 since the flow channel length of the branch channel 16#1 is relatively long). In this way, according to the present embodiment, the branch channel 16 to which the hollow layer 24 is applied is properly selected, and furthermore the formation range of the hollow layer 24 in the branch channel 16#1 is properly determined as described above. Therefore, securement of activation of the catalyst and reduction of overheat of the catalyst during a high-load operation can be both achieved with good balance as described above while the manufacturing cost of the manifold channel 14*a* by the three-dimensional modeling device is reduced.

Figure 4:
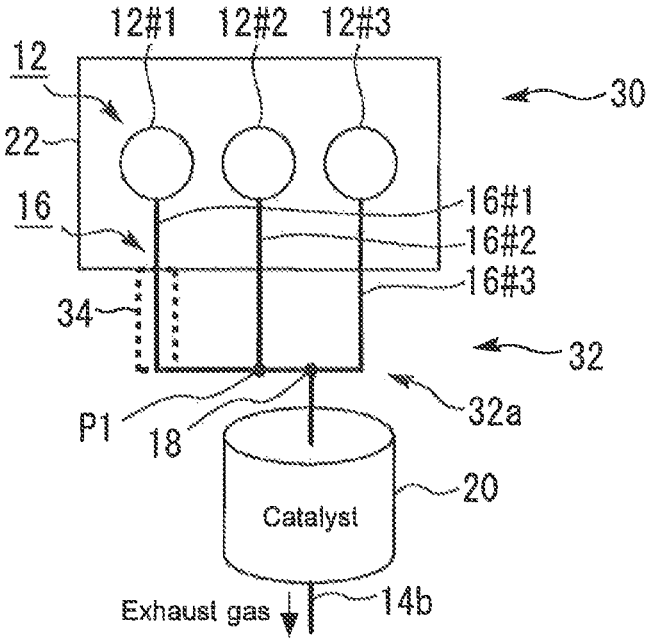
FIG. 4 is a schematic diagram that illustrates a configuration of an internal combustion engine according to a first modification example with respect to the first embodiment of the present disclosure.
Figure 5:
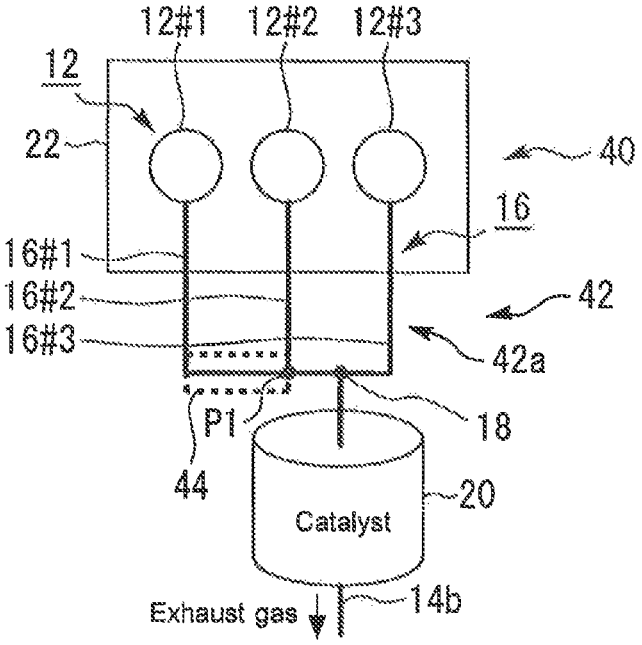
FIG. 5 is a schematic diagram that illustrates a configuration of an internal combustion engine according to a second modification example with respect to the first embodiment of the present disclosure.
Figure 6:
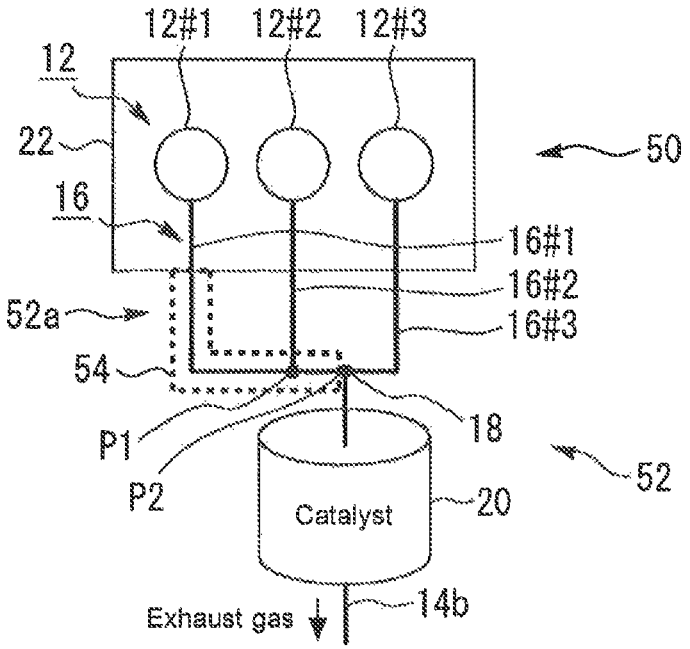
FIG. 6 is a schematic diagram that illustrates a configuration of an internal combustion engine according to a third modification example with respect to the first embodiment of the present disclosure.

Additionally, the formation range of the hollow layer that is provided so as to cover the branch channel 16#1 connected to the longest cylinder 12#1 may not be always determined as with the example of the first embodiment 1 described above, and may be determined as with the following examples shown in FIGS. 4 to 6.

FIG. 4 is a schematic diagram that illustrates a configuration of an internal combustion engine 30 according to a first modification example with respect to the first embodiment of the present disclosure. An exhaust channel 32 of the internal combustion engine 30 shown in FIG. 4 is provided with a manifold channel 32*a*. In the manifold channel 32*a*, as with the manifold channel 14*a*, a hollow layer 34 is provided only for the branch channel 16#1 connected to the longest cylinder 12#1. The hollow layer 34 is formed so as to be shorter than the hollow layer 24 shown in FIG. 1 and to extend to a location of the branch channel 16#1 on the upstream side of the position P1 from the end portion of the branch channel 16#1 on the side of the cylinder head 22.

Next, FIG. 5 is a schematic diagram that illustrates a configuration of an internal combustion engine 40 according to a second modification example with respect to the first embodiment of the present disclosure. An exhaust channel 42 of the internal combustion engine 40 shown in FIG. 5 is provided with a manifold channel 42*a*. In the manifold channel 42*a*, a hollow layer 44 that is provided only for the branch channel 16#1 is formed as follows. To be more specific, although the hollow layer 44 is the same as the hollow layer 34 shown in FIG. 4 in that the hollow layer 44 is shorter than the hollow layer 24 shown in FIG. 1, the hollow layer 44 is formed so as to extend to the position P1 from a location of the branch channel 16#1 on the downstream side of the end portion of the branch channel 16#1 on the side of the cylinder head 22.

Next, FIG. 6 is a schematic diagram that illustrates a configuration of an internal combustion engine 50 according to a third modification example with respect to the first embodiment of the present disclosure. An exhaust channel 52 of the internal combustion engine 50 shown in FIG. 6 is provided with a manifold channel 52*a*. In the manifold channel 52*a*, a hollow layer 54 that is provided only for the branch channel 16#1 is formed as follows. That is, the hollow layer 54 is longer than the hollow layer 24 shown in FIG. 1 and is formed so as to extend to the collective portion 18 (the position P2) from a connecting position of the exhaust manifold with the cylinder head 22. To be more specific, the hollow layer 54 is formed at the entire portion of the branch channel 16#1 that is configured as a channel in the exhaust manifold (in detail, formed so as to extent to a zone (P1-P2) equivalent to the common branch channel between the branch channel 16#1 and the branch channel 16#2).

Moreover, the hollow layer that covers the branch channel 16#1 corresponding to the longest cylinder 12#1 may be formed so as to, cover the whole of the branch channel 16#1 that extends from the cylinder 12#1 to the collective portion 18 including a portion of the branch channel 16#1 in the cylinder head 22 (that is, a channel in the exhaust port), although its illustration is omitted here. In the example of this configuration, a portion around the hollow layer may be formed by means of a three-dimensional modeling device, for example. More specifically, the exhaust manifold and the portion of the cylinder head 22 at least around the exhaust port may be formed individually by means of the three-dimensional modeling device. In this example, the channel wall of the branch channel in the exhaust manifold and the wall of the hollow layer that covers the periphery of the channel wail are formed integrally and continuously with the same material X, and the channel wall of the branch channel in the cylinder head 22 and the wall of the hollow layer that covers the periphery of the channel wall are formed integrally continuously with the same material Y. In addition, the material X may be the same as the material Y or be different from the material Y.

As with the examples shown in FIGS. 4 to 6 and the aforementioned example that is not shown in the drawings, it is favorable that the formation range of a hollow layer that covers the branch channel 16#1 is properly set on the basis of the concept described in the first embodiment by taking into consideration the specification and the mounting environment of the internal combustion engine 10 to which the hollow layer is applied.

Figure 7:
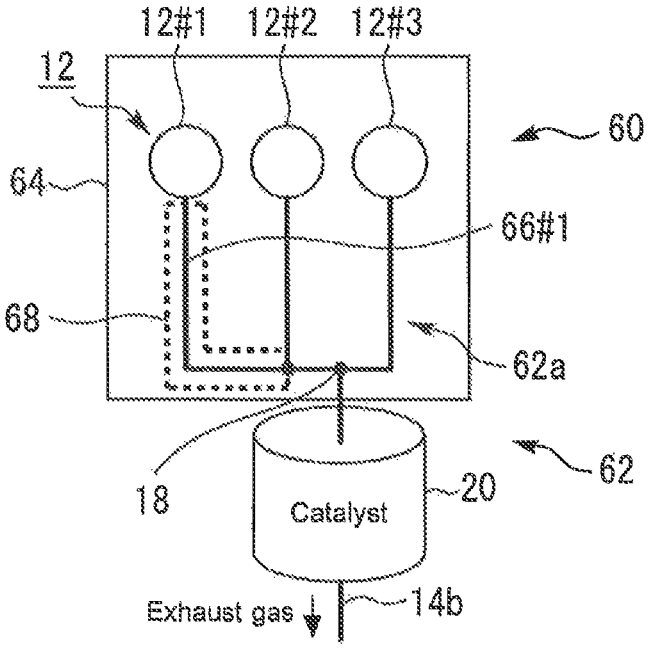
FIG. 7 is a schematic diagram that illustrates a configuration of an internal combustion engine according to a fourth modification example with respect to the first embodiment of the present disclosure.

Furthermore, FIG. 7 is a schematic diagram that illustrates a configuration of an internal combustion engine 60 according to a fourth modification example with respect to the first embodiment of the present disclosure. An exhaust channel 62 of the internal combustion engine 60 shown in FIG. 7 is provided with a manifold channel 62*a*. In this example, the whole of the manifold channel 62*a* is formed in a cylinder head 64. In the manifold channel 62*a*, similarly to the examples described above, a hollow layer 68 is formed so as to cover a branch channel 66#1 connected to the cylinder 12#1. The whole of the hollow layer 68 is formed in cylinder head 64. The formation range of the hollow layer 68 is not limited to the example shown in FIG. 7, and may be properly adjusted on the basis of the concept described in the first embodiment. The hollow layer 68 can be properly formed by funning a portion of the cylinder head 64 at least around the branch channel 66#1 by means of, for example, a three-dimensional modeling device. In addition, as with the relationship between the example shown in FIG. 1 and the example shown in FIG. 7, the whole of each of a manifold channel 72*a* and the other manifold channels in the following second to seventh and ninth embodiments may also be formed in the cylinder head.

Second Embodiment

Figure 8:
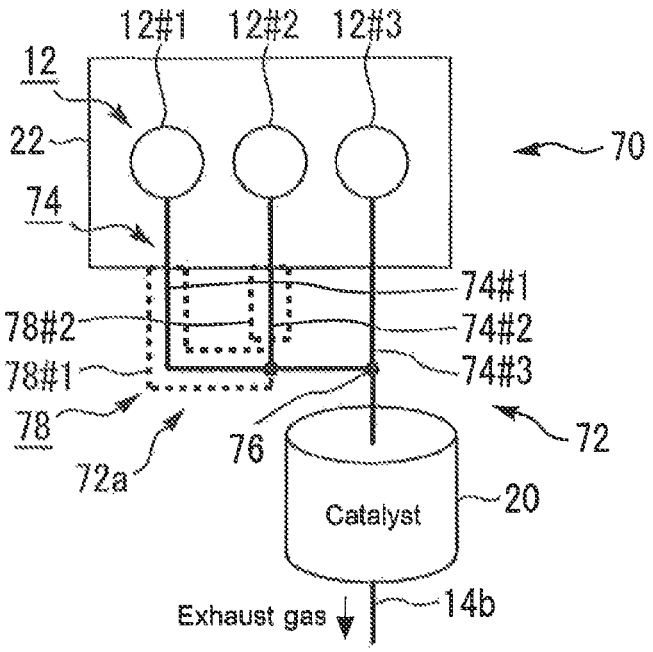
FIG. 8 is a schematic diagram that illustrates a configuration of an internal combustion engine according to a second embodiment of the present disclosure.

Next, a second embodiment of the present disclosure will be described with reference to FIG. 8. FIG. 8 is a schematic diagram that illustrates a configuration of an internal combustion engine 70 according to the second embodiment of the present disclosure. In addition, in each of the second embodiment and the subsequent embodiments, a channel wall around a hollow layer and the wall (outer wall) of the hollow layer can be similarly formed by means of, for example, a three-dimensional modeling device, as shown in FIGS. 2 and 3. Because of this, in each of these embodiments, the illustration of the channel wall around the hollow layer and the wail of the hollow layer and explanation thereof are omitted or abbreviated.

An exhaust channel 70 of the internal combustion engine 70 shown in FIG. 8 is provided with the manifold channel 72*a* having three branch channels 74#1, 74#2 and 74#3. The exhaust gases from the three branch channels 74 are collected into one at once at a collective portion 76. In the internal combustion engine 70, the lengths of the three branch channels 74 are different from each other. In more detail, as shown in FIG. 8, the branch channel 74#1 is the longest, followed by the branch channel 74#2 and the branch channel 74#3 in this order. Thus, in this example, the cylinder 12#1 corresponds to the "longest cylinder" and the cylinder 12#3 corresponds to the "shortest cylinder". Also, the center cylinder 12#2 corresponds to an "intermediate cylinder" whose flow channel length to the collective portion 18 is shorter than that of the longest cylinder 12#1 and longer than that of the shortest cylinder 12#2, In contrast to the first embodiment, the manifold channel 72*a* shown in FIG. 8 is provided with not only a hollow layer 78#1 that covers the branch channel 74#1 corresponding to the longest cylinder 12#1 but also a hollow layer 78#2 (which corresponds to a "third hollow layer" according to the present disclosure) that covers a part of a channel wall (not shown) in a flow channel direction (which corresponds to a "third flow channel direction" according to the present disclosure) of the branch channel 74#2 corresponding to the intermediate cylinder 12#2. As an example, the length of the hollow layer 78#1 corresponding to the longest cylinder 12#1 is similar to that of the hollow layer 24 shown in FIG. 1. The hollow layer 78#2 corresponding to the intermediate cylinder 12#2 has a length that is shorter than that of the hollow layer 78#1 corresponding to the longest cylinder 12#1, and is formed se as to cover a part of the branch channel 74#2. On the other hand, a similar hollow layer is not provided for the branch channel 74#3 corresponding to the shortest cylinder 12#3.

As described so far, according to the manifold channel 72*a* of the present embodiment, with respect to the longest cylinder 12#1 and the intermediate cylinder 12#2, the hollow layers 78#1 and 78#2 arc provided while satisfying a requirement that the length of the hollow layer 78 become longer when the branch channel 74 is longer. Therefore, the longer the branch channel 74 is, the more effectively a decrease in temperature of the exhaust gas can be reduced when the exhaust gas flows through the branch channel 74. Also, by properly selecting the length of each hollow layer 78 on the basis of the concept described in the first embodiment while satisfying the requirement described above, the temperature of the exhaust gases that reach the collective portion 76 from the longest cylinder 12#1 and the intermediate cylinder 12#2 can be caused to approach the temperature of the exhaust gas that reaches the collective portion 76 from the shortest cylinder 12#3.

Third Embodiment

Next, a third embodiment of the present disclosure will be described with reference to FIG. 9.

Figure 9:
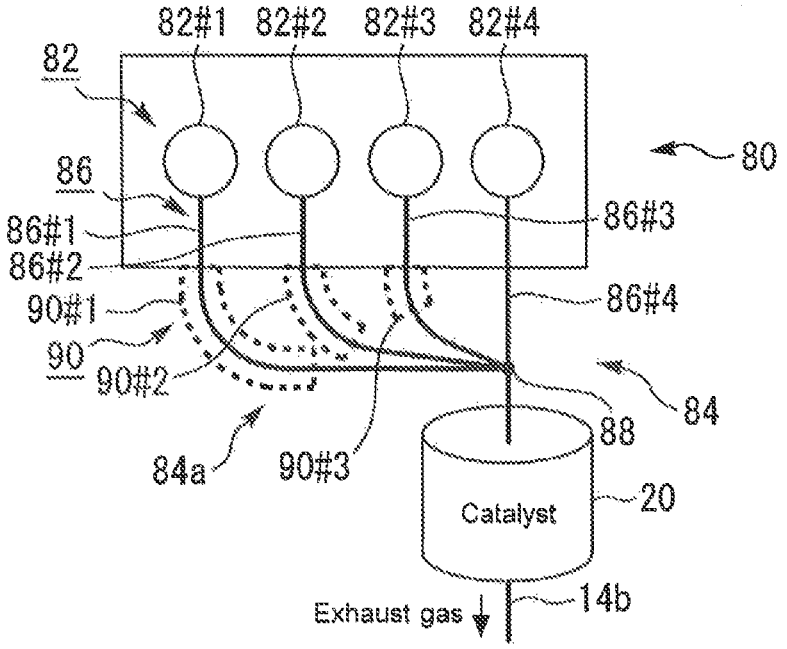
FIG. 9 is a schematic diagram that illustrates a configuration of an internal combustion engine according to a third embodiment of the present disclosure.

FIG. 9 is a schematic diagram that illustrates a configuration of an internal combustion engine 80 according to the third embodiment of the present disclosure. The internal combustion engine 80 shown in FIG. 9 is an in.-line four-cylinder engine that includes four cylinders 82#1, 82#2, 82#3 and 82#4. An exhaust channel 84 of the internal combustion engine 80 is provided with a manifold channel 84*a*. The manifold channel 84*a* is provided with four branch channels 86#1, 86#2, 86#3 and 86#4 that are connected to the respective cylinders 82.

The exhaust gases from four branch channels 86 are collected into one at once at a collective portion 88. The lengths of the four branch channels 86 are different from each other. In more detail, as shown in FIG. 9, the branch channel 86#1 is the longest, followed by the branch channel 86#2, the branch channel 86#3 and the branch channel 86#4 in this order. Thus, the internal combustion engine 80 is provided with a plurality of (as an example, two) intermediate cylinders 82#2 and 82#3 as well as the longest cylinder 82#1 and the shortest cylinder 82#4.

On that basis, the manifold channel 84*a* shown in FIG. 9 is provided with hollow layers 90#1, 90#2 and 90#3 that respectively correspond to the longest cylinder 82#1 and two intermediate cylinders 82#2 and 82#3. The lengths of these hollow layers 90 are proportional to the lengths of the branch channels 86. That is, the basic concept of the formation range of each hollow layer 90 is similar to that in the second embodiment. However, the manifold channel 84*a* has two intermediate cylinders 82#2 and 82#3. Therefore, the hollow layer 90#2 that covers the branch channel 86#2 that is relatively long is longer than the hollow layer 90#3 that covers the branch channel 86#3 that is relatively short.

According to the manifold channel 84*a* of the present embodiment described so far, in the internal combustion engine 80 that includes the plurality of (two) intermediate cylinders 82#2 and 82#3 that are different from each other with respect to the lengths of the respective branch channels 86, the longer the branch channel 86 is, the more effectively a decrease in temperature of the exhaust gas can be reduced when the exhaust gas flows through the branch channel 86. Also, other advantageous effects that are similar to those of the third embodiment can be achieved.

Fourth Embodiment

Next, a fourth embodiment of the present disclosure will be described with reference to FIG. 10.

Figure 10:
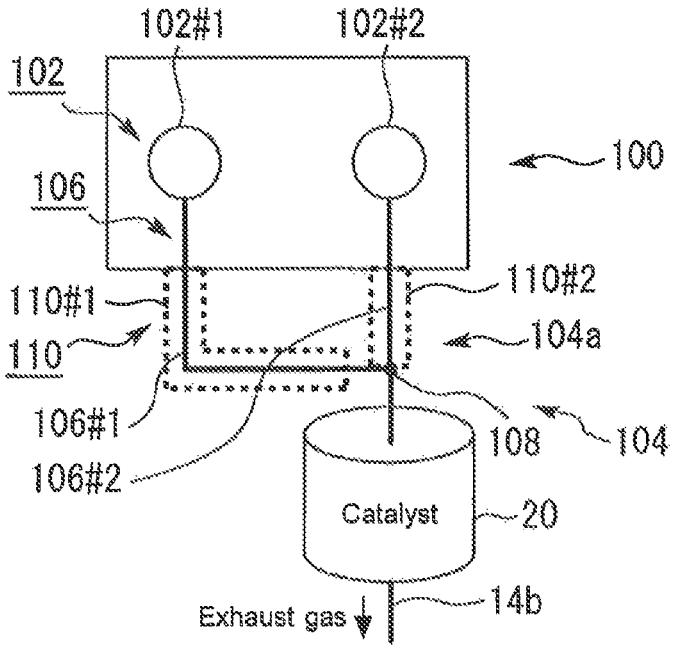
FIG. 10 is a schematic diagram that illustrates a configuration of an internal combustion engine according to a fourth embodiment of the present disclosure.

FIG. 10 is a schematic diagram that illustrates a configuration of an internal combustion engine 100 according to the fourth embodiment of the present disclosure. The internal combustion engine 100 shown in FIG. 10 is an in-line two-cylinder engine that includes two cylinders 102#1 and 102#2. An exhaust channel 104 of the internal combustion engine 100 is provided with a manifold channel 104*a*. The manifold channel 104*a* is provided with two branch channels 106#1 and 106#2 that are connected to the respective cylinders 102. The exhaust gases from the two branch channels 106 are collected into one at a collective portion 108. The branch channel 106#1 is longer than the branch channel 106#2. Thus, in the internal combustion engine 100, the cylinder 102#1 corresponds to the "longest cylinder" and the cylinder 102#2 corresponds to the "shortest cylinder".

On that basis, the manifold channel 104*a* shown in FIG. 10 is provided with not only a hollow layer 110#1 corresponding to the longest cylinder 102#1 but also a hollow layer 110#2 (which corresponds to a "second hollow layer" according to the present disclosure) corresponding to the shortest cylinder 102#2, in contrast to the first to third embodiments. The hollow layer 110#2 that covers a part of a channel wall (not shown) in a flow channel direction (which corresponds to a "second flow channel direction" according to the present disclosure) of the branch channel 106#2 that is relatively short is formed so as to be shorter than the hollow layer 110#1 that covers the branch channel 106#1 that is relatively long.

According to the manifold channel 14*a* of the first embodiment, a temperature decrease of the exhaust gases that flow in the flow channels from the shortest cylinders 12#2 and 12#3 to the collective portion 18 is allowed (that is, countermeasures against the temperature decrease are not taken). This also applies to the second and third embodiments, in contrast to this, according to the manifold channel 104*a* of the present embodiment described so far, a requirement that the hollow layer 110#1 is longer than the hollow layer 110#2 is satisfied. As a result, a temperature decrease of the exhaust gas that flows in the flow channel from the longest cylinder 12#1 to the collective portion 108 is reduced more effectively than those of the other exhaust gases. However, in the present embodiment, a temperature decrease of the exhaust gas from the shortest cylinder 102#2 is also reduced. As a result, the temperature of the exhaust gas that flows into the collective portion 108 from the shortest cylinder 102#2 becomes higher as compared with an example without the hollow layer 110#2. Thus, according to the configuration of the present embodiment that includes the hollow layer 110#2 corresponding to the shortest cylinder 102#2, by properly selecting the length of each hollow layer 110 while satisfying the requirement described above, the temperature decrease of the exhaust gas from the longest cylinder 102#1 can be compensated by the exhaust gas that flows into the shortest cylinder 102#2. Furthermore, two hollow layers 110 are not formed so as to extend over the whole of all the branch channels 106 of the manifold channel 104*a*. Therefore, according to the configuration of the present embodiment, as with the first embodiment, securement of activation of the catalyst and reduction of overheat of the catalyst during a high-load operation can be both achieved with good balance.

Fifth Embodiment

Next, a fifth embodiment of the present disclosure will be described with reference to FIG. 11.

Figure 11:
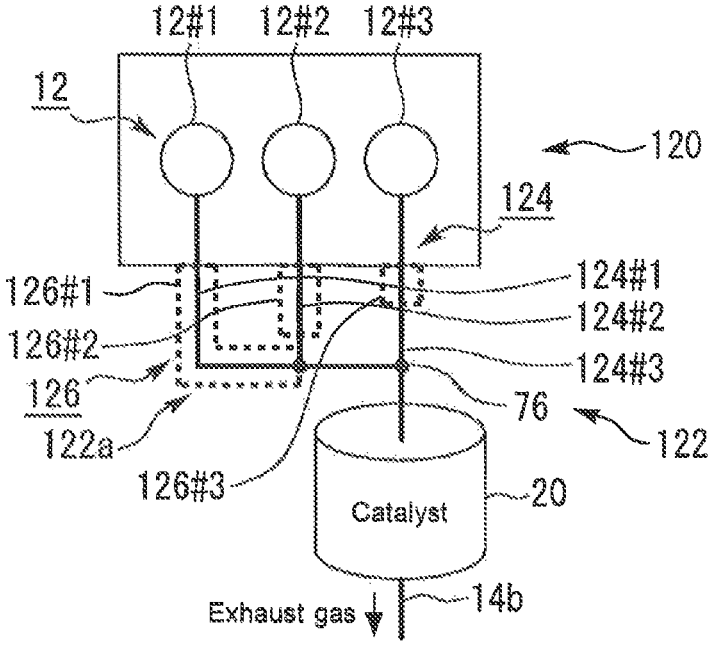
FIG. 11 is a schematic diagram that illustrates a configuration of an internal combustion engine according to a fifth embodiment of the present disclosure.

FIG. 11 is a schematic diagram that illustrates a configuration of an internal combustion engine 120 according to the fifth embodiment of the present disclosure. An exhaust channel 122 of the internal combustion engine 120 shown in FIG. 11 is provided with a manifold channel 122*a*. With respect to the lengths of three branch channels 124 which the manifold channel 122*a* includes, the branch channel 124#1 is the longest, followed by the branch channel 124#2 and the branch channel 124#3. The distinction between this manifold channel 122*a* and the manifold channel 104*a* according to the fourth embodiment is as follows. That is, in contrast to the internal combustion engine 100, the internal combustion engine 120 is provided with an intermediate cylinder 12#2. Accordingly, in the manifold channel 122*a*, hollow layers 126#1, 126#2 and 126#3 that cover the respective branch channels 124 are formed so as to be longer in proportion to the lengths of the branch channels 124#1, 124#2 and 124#3 while taking into consideration the presence of the branch channel 12#2 connected to the intermediate cylinder 12#2.

According to the manifold channel 122*a* of the present embodiment described so far, since a requirement that when the branch channel 124 is longer, the corresponding hollow layer 126 becomes longer is satisfied, the degree of temperature decrease of the exhaust gases that flow in the flow channels from each cylinder 12 to the collective portion 76 are the highest in the longest cylinder 12#1, followed by the intermediate cylinder 12#2 and the shortest cylinder 12#3 in this order. In this way, according to the present embodiment, as with the fourth embodiment, the hollow layer 126#3 corresponding to the shortest cylinder 12#3 is provided. Thus, by properly selecting the length of each hollow layer 126 while satisfying the requirement described above, the temperature decrease of the exhaust gases from the longest cylinder 12#1 and the intermediate cylinder 12#3 can be compensated by the exhaust gas that flows from the shortest cylinder 12#3. Furthermore, other advantageous effects that are similar to those of the fourth embodiment can be achieved.

Sixth Embodiment

Next, a sixth embodiment of the present disclosure will be described with reference to FIG. 12.

Figure 12:
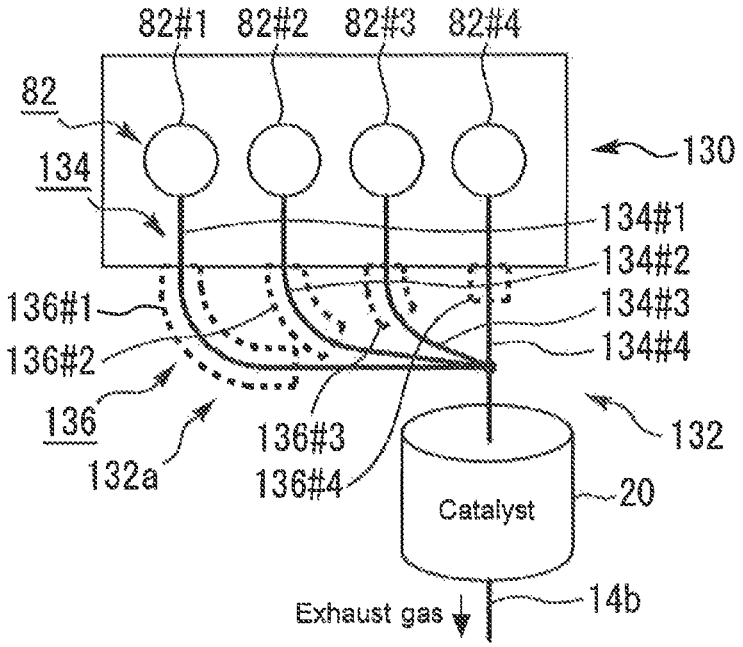
FIG. 12 is a schematic diagram that illustrates a configuration of an internal combustion engine according to a sixth embodiment of the present disclosure.

FIG. 12 is a schematic diagram that illustrates a configuration of an internal combustion engine 130 according to the sixth embodiment of the present disclosure. An exhaust channel 132 of the internal combustion engine 130 shown in FIG. 12 is provided with a manifold channel 132*a*. With respect to the lengths of four branch channels 134 which the manifold channel 132*a* includes, the branch channel 134#1 is the longest, followed by the branch channel 134#2, the branch channel 134#3 and the branch channel 134#4 in this order. The distinction between this manifold channel 132*a* and the manifold channel 122*a* according to the fifth embodiment is as follows. That is, in contrast to the internal combustion engine 120, the internal combustion engine 130 is provided with a plurality of (as an example, two) intermediate cylinders 82#2 and 82#3 Accordingly, in the manifold channel 132*a*, the hollow layers 136#1, 136#2, 136#3 and 136#4 that cover the respective branch channels 134 are formed so as to satisfy a requirement that the hollow layers 136 become longer in proportion to the lengths of the corresponding branch channels 134#1, 134#2, 134#3 and 134#4, while taking into consideration the presence of the branch channels 134#2 and 134#3 that are respectively connected to two intermediate cylinders 82#2 and 82#3.

The manifold channel 132*a* according to the present embodiment described so far is provided with the hollow layer 136#4 corresponding to the shortest cylinder 82#4, as in the fourth and fifth embodiments. Thus, by properly selecting the length of each hollow layer 136 while satisfying the requirement described above, the temperature decrease of the exhaust gases from the longest cylinder 82#1 and the intermediate cylinders 82#2 and 82#3 can be compensated by the exhaust gas that flows from the shortest cylinder 81#4. Furthermore, other advantageous effects that are similar to those of the fifth embodiment can be achieved.

Seventh Embodiment

Next, a seventh embodiment of the present disclosure will be described with reference to FIG. 13.

Figure 13:
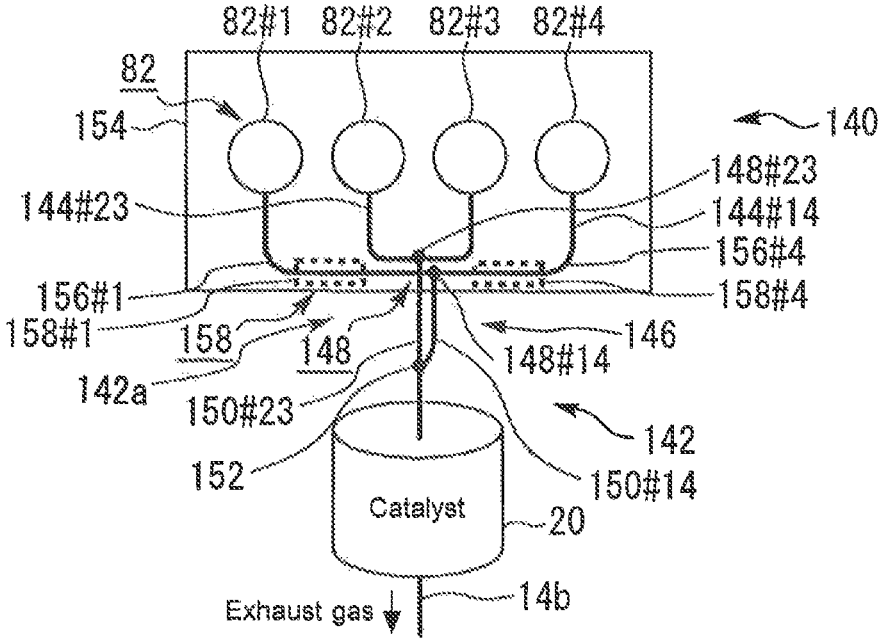
FIG. 13 is a schematic diagram that illustrates a configuration of an internal combustion engine according to a seventh embodiment of the present disclosure.

FIG. 13 is a schematic diagram that illustrates a configuration of an internal combustion engine 140 according to the seventh embodiment of the present disclosure. An exhaust channel 142 of the internal combustion engine 140 shown in FIG. 13 is provided with a manifold channel 142*a*. The manifold channel 142*a* is provided with two primary manifold channels 144#14 and 144#23 and one secondary manifold channel 146.

The primary manifold channel 144#14 is a flow channel through which exhaust gases from a first cylinder group (cylinders 82#1 and 82#4) flow, and is provided with a primary collective portion 148#14 in which the exhaust gases are collected into one. The other primary manifold channel 144#23 is a flow channel through. Which exhaust gases from a second cylinder group (cylinders 82#2 and 82#3) flow, and is provided with a primary collective portion 148#23 in which the exhaust gases are collected into one.

The secondary manifold channel 146 is provided with a common branch channel 150#14 connected to the primary collective portion 148#14, a common branch channel 150#23 connected to the primary collective portion 148#23, and a secondary collective portion 152 in which the common branch channel 150#14 and the common branch channel 150#23 are joined with each other. The exhaust gases from all the cylinders 82 are collected into one at this secondary collective portion 152.

In the example shown in FIG. 13, the two primary manifold channels 144#14 and 144#23 are formed in a cylinder head 154. On the other hand, the second manifold channel 146 is formed as a channel in an exhaust manifold (not shown) that is connected to the cylinder head 154. In addition, a common channel 14*b* in which the catalytic device 20 is arranged is located on the downstream side of the secondary collective portion 152.

In the manifold channel 142*a* having the configuration described above, the following shows a result of comparing, between cylinders, the flow channel lengths from the individual cylinders 82 to the secondary collective portion 152. That is, first, as shown in FIG. 13, the flow channel lengths from the individual cylinders 82 to the primary collective portions 148 (148#14 and 148#23) are longer in the first cylinder group (cylinders 82#1 and 82#4) than in the second cylinder group (cylinders 82#2 and 82#3). Moreover, the flow channel lengths from each of the primary collective portions 148#14 and 148#23 (that is, the flow channel lengths of both of the common branch channel 150#14 and the common branch channel 150#23) are equal in the example shown in FIG. 13. Thus, the flow channel length from the first cylinder group to the secondary collective portion 152 is longer than the flow channel length from the second cylinder group to the secondary collective portion 152.

Based on the above, in the present embodiment, the cylinders 82#1 and 82#4 that belong to the first cylinder group correspond to the longest cylinders, and the cylinders 82#2 and 82#3 that belong to the second cylinder group correspond to the shortest cylinders. Accordingly, in the present embodiment, hollow layers 158#1 and 158#4 are provided, as shown in FIG. 13, so as to respectively cover branch channels 156#1 and 156#4 of the primary manifold channel 144#14 of the first cylinder group. On the other hand, similar hollow layers are not provided with respect to the primary manifold channel 144#23 and the common branch channel 150#23 of the second cylinder group. In addition, the concept of the formation range of the hollow layers 158 is the same as that in the first embodiment.

According to the manifold channel 142*a* of the present embodiment described so far, as in the first embodiment, temperature decrease of the exhaust gases can be reduced with respect to the longest cylinders 82#1 and 82#4 in which the flow channel lengths from each cylinder 82 to the secondary collective portion 152 (that is, a portion where the exhaust gases are finally collected into one) are relatively long. Advantageous effects that are similar to those of the first embodiment can therefore be achieved.

Additionally, in the seventh embodiment described above, the hollow layers 158 are provided with respect to the primary manifold channel 144#14 of the longest cylinders 82#1 and 82#4. However, a portion at which this kind of hollow layers 158 are arranged may be the common branch channel 150#14 located on the downstream side of the primary collective portion 148#14 instead of, or as well as, the primary manifold channel 144#14.

Furthermore, with respect to the manifold channel 142*a* having the flow channel configuration shown in FIG. 13, a concept that is similar to that of the fourth embodiment may be applied. In more detail, as well as the hollow layers 158 corresponding to the longest cylinders (first cylinder group), hollow layers corresponding to the shortest cylinders (second cylinder group) may be provided, as far as the hollow layers are shorter than the hollow layers 158.

Eighth Embodiment

Next, an eighth embodiment of the present disclosure will be described with reference to FIG. 14.

Figure 14:
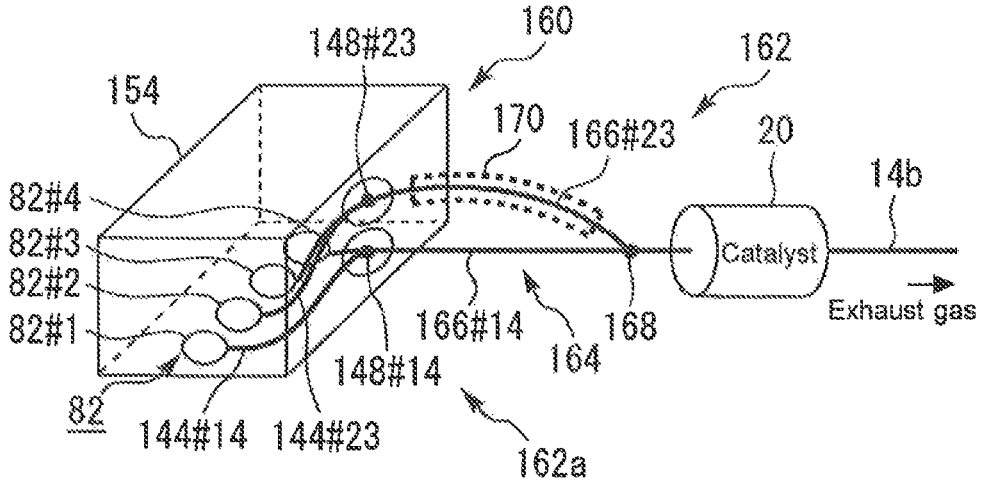
FIG. 14 is a perspective diagram that schematically illustrates a configuration of an internal combustion engine according to an eighth embodiment of the present disclosure.

FIG. 14 is a perspective diagram that schematically illustrates a configuration of an internal combustion engine 160 according to the eighth embodiment of the present disclosure. An exhaust channel 162 of the internal combustion engine 160 shown in FIG. 14 is provided with a manifold channel 162*a*. The manifold channel 162*a* is provided with two primary manifold channels 144#14 and 144#23 (which are the same as those of the internal combustion engine 140 shown in FIG. 13) and one secondary manifold channel 164.

Each of the primary collective portion 148414 and the primary collective portion 148#23 opens at a side surface of the cylinder head 154. The secondary manifold channel 164 is provided with a common branch channel 166#14 connected to the primary collective portion 148#14, a common branch channel 166#23 connected to the primary collective portion 148#23 and a secondary collective portion 168 at which the common branch channel 166#14 and the common branch channel 166#23 are joined with each other.

As already described, two primary manifold channels 144#14 and 144#23 are formed in the cylinder head 154. On the other hand, in the example shown in FIG. 14, the whole of the secondary manifold channel 164 is formed as a channel in an exhaust manifold (not shown) that is connected to the cylinder head 154. Thus, the common branch channel 166#23 corresponds to a "first outer common branch channel" according to the present disclosure, and the common branch channel 166#14 corresponds to a "second outer common branch channel" according to the present disclosure, in addition, in an example in which a portion of a common branch channel is located in a cylinder head, the remaining portion of the common branch channel corresponds to the first or second outer common branch channel.

As shown in FIG. 14, in the manifold channel 162*a*, the common branch channel 166#23 is longer than the common branch channel 166#14. Accordingly, in the present embodiment, a hollow layer 170 (which corresponds to a "fourth hollow layer" according to the present disclosure) is provided, as shown in FIG. 14, so as to cover a part of a channel wall (not shown) in a flow channel direction of the common branch channel 166#23 (which corresponds to a "fourth flow channel direction" according to the present disclosure). On the other hand, a similar hollow layer is not provided for the common branch channel 166#14. In addition, the concept of the formation range of the hollow layer 170 is the same as that in the first embodiment. Therefore, in contrast to the example shown in FIG. 14, the whole of the common branch channel 166#23 may be covered as needed by a hollow layer.

According to the manifold channel 162*a* of the present embodiment described so far, by taking into consideration the difference in length of the common branch channels 166#23 and 166#14 that are located outside the cylinder head 154, temperature decrease of the exhaust gases can be reduced with respect to the common branch channel 166#23 that is relatively long. Moreover, in the present embodiment, as in the first embodiment, hollow layers that are not provided in such a manner as to cover the whole of the manifold channel 162*a*. Therefore, according to the manifold channel 162*a* of the present embodiment, as in the first embodiment, the temperature management of the catalyst can be performed more properly while taking into consideration a good balance between securement of activation of the catalyst and reduction of overheat of the catalyst during a high-load operation.

In further addition to the above, it can be said that ease of heat release from the exhaust gases flowing through the manifold channel 162*a* to the outside is different depending on whether the heat release occurs inside or outside the cylinder head 154. It can therefore be said that selecting, based on the length of the flow channel located outside the cylinder head 154, portions where hollow layers are arranged, as in the present embodiment, is also meaningful, instead of the above-described first to seventh embodiments in which portions where hollow layers are arranged are selected based on the flow channel lengths from the cylinders.

Figure 15:
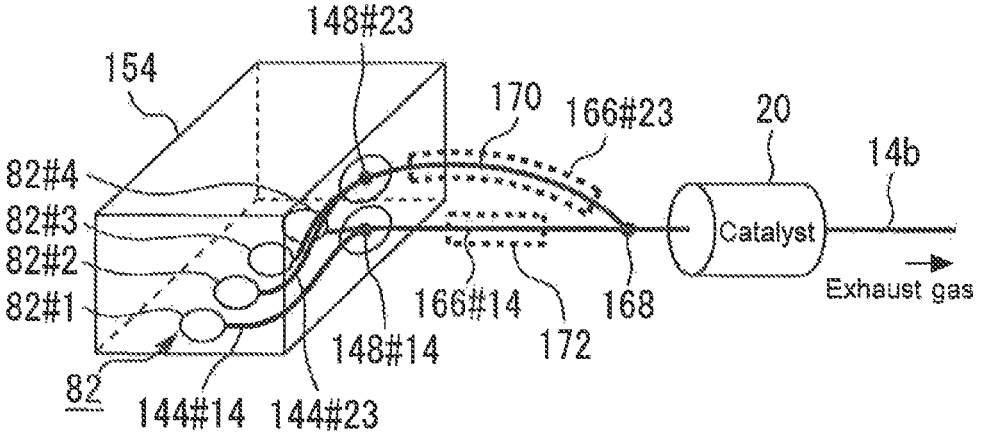
FIG. 15 is a perspective diagram that schematically illustrates a configuration of an internal combustion engine according to a modification example with respect to the eighth embodiment of the present disclosure.

Furthermore, with respect to the manifold channel 162*a* having the flow channel configuration shown in FIG. 14, a concept that is similar to that in the fourth embodiment may be applied. In more detail, as shown in FIG. 15, as well as the common branch channel 166#23, a hollow layer 172 (which corresponds to a "fifth hollow layer" according to the present disclosure) that covers a part of a channel wall (not shown) in a flow channel direction of the common branch channel 166#14 (which corresponds to a "fifth flow channel direction" according to the present disclosure) may be provided, as far as the hollow layer 172 is shorter than the hollow layer 170.

Ninth Embodiment

Next, a ninth embodiment of the present disclosure will be described with reference to FIG. 16.

Figure 16:
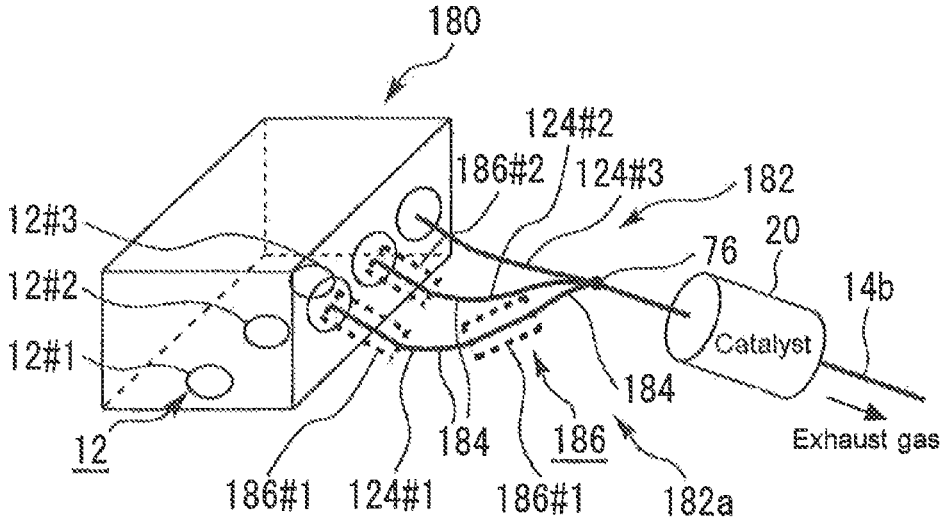
FIG. 16 is a perspective diagram that schematically illustrates a configuration of an internal combustion engine according to a ninth embodiment of the present disclosure.

FIG. 16 is a perspective diagram that schematically illustrates a configuration of an internal combustion engine 180 according to the ninth embodiment of the present disclosure. An exhaust channel 182 of the internal combustion engine 180 shown in FIG. 16 is provided with a manifold channel 182*a*. Three branch channels which the manifold channel 182*a* include are the same as the three branch channels 124 of the internal combustion engine 120 shown in FIG. 11. That is, with respect to the lengths of these branch channels 124, the branch channel 124#1 is the longest, followed by the branch channel 124#2 and the branch channel 124#3 in this order.

With respect to the configuration in which a part of a channel wall of a branch channel is covered by a hollow layer, the present embodiment has a feature in selection method for a portion to which the hollow layer is provided. To be more specific, as with bending portions 184 of the manifold channel 182*a* shown in FIG. 16, a branch channel of a manifold channel may include a bending portion. In the bending portion, stagnation is likely to occur in the flow of the exhaust gas due to disturbance of its streamline. The temperature of the bending portion is therefore easy to be higher than that of a straight portion. In other words, in the bending portion, the temperature of the exhaust gas is hard to be lower than that in the straight portion. It is conceivable that a hollow layer is more effective when the hollow layer is provided at the straight portion or a substantially straight portion (that is, a portion equivalent to the straight portion) where the temperature of the exhaust gas is easy to decrease, than when the hollow layer is provided at the bending portion where the temperature of the exhaust gas is hard to decrease as just described.

Accordingly, as an example, the manifold channel 182*a* is provided with a hollow layer 186#1 for covering a part of the branch channel 124#1 corresponding to the longest cylinder 12#1 and a hollow layer 186#2 for covering a part of the branch channel 124#2 corresponding to the intermediate cylinder 12#2. In the present embodiment, with respect to providing these hollow layers 186, the following arrangement is arcade by taking into consideration the presence of the bending portions 184. To be more specific, as shown in FIG. 16, the hollow layers 186#1 and 186#2 are arranged not at the bending portions 184 but at the straight portions. As an example, the hollow layer 186#1 for the branch channel 124#1 whose flow channel length is longer is provided in such a manner as to be divided for two straight portions of the branch channel 124#1. The hollow layer 186#2 is provided at one straight portion of the branch channel 124#2. In addition, the hollow layers 186 may be provided at a portion that is substantially straight.

According to the manifold channel 182*a* of the present embodiment described so far, the hollow layers 186 are provided not at the bending portions 184 of the branch portions 124 but at the straight portions at which the temperature of the exhaust gas is easy to decrease as compared with the bending portions 184. Therefore, the heat retaining property of the manifold channel 182*a* due to providing the hollow layers 186 can be improved more effectively.

Additionally, the above-described manner that a portion to which a hollow layer is provided is selected with taking into consideration the presence of a bending portion of a branch channel may be applied not only to the hollow layer 186#1 corresponding to the longest cylinder 12#1 (which corresponds to a "first hollow layer" according to the present disclosure) and the hollow layer 186#2 corresponding to the intermediate cylinder 12#2 (which corresponds to a "third hollow layer" according to the present disclosure)in the present embodiment but also to other hollow layers which have been described so far. In detail, the above described manner may also be applied, for example, to the hollow layer 110#2 corresponding to the shortest cylinder 102#2 shown in FIG. 10 (which corresponds to a "second hollow layer" according to the present disclosure) and the hollow layer 170 corresponding to the common branch channel 166#23 shown in FIG. 14 (which corresponds to a "fourth hollow layer" according to the present disclosure). Furthermore, in an example in which the hollow layer 172 is provided with respect to the common branch channel 166#14 as shown in FIG. 15, the above described manner may also be applied to the hollow layer 172 (which corresponds to a "fifth hollow layer" according to the present disclosure).

What is claimed is:

1. An internal combustion engine, comprising:

an exhaust channel that includes a manifold channel including a plurality of branch channels that are respectively connected to a plurality of cylinders and a collective portion where exhaust gases flowing through the plurality of branch channels are collected into one, and a common channel arranged on a downstream side of the collective portion; and a catalytic device that is arranged in the common channel and configured to purify the exhaust gases, wherein, with respect to a longest cylinder that is a cylinder whose flow channel length from the cylinder to the collective portion is the longest among the plurality of cylinders, the manifold channel includes a first hollow layer that covers a part or a whole of a first channel wall in a first flow channel direction of a corresponding branch channel that is connected to the longest cylinder, wherein, with respect to a shortest cylinder that is a cylinder whose flow channel length from the cylinder to the collective portion is the shortest among the plurality of cylinders and other than the longest cylinder, the manifold channel does not include a second hollow layer that covers a corresponding branch channel that is connected to the shortest cylinder, and wherein a wall that forms the first hollow layer is formed integrally and continuously with a same material as the first channel wall, and a plurality of support columns formed at predetermined intervals in the first flow channel direction connect the first channel wall and the wall that forms the first hollow layer.

2. The internal combustion engine according to claim 1, wherein the plurality of cylinders includes, other than the longest cylinder and the shortest cylinder, an intermediate cylinder that is a cylinder whose flow channel length to the collective portion is shorter than that of the longest cylinder and longer than that of the shortest cylinder, wherein the manifold channel includes a third hollow layer which covers a part of a channel wall in a third flow channel direction of a corresponding branch channel that is connected to the intermediate cylinder, and whose length in the third flow channel direction is shorter than that of the first hollow layer in the first flow channel direction, and wherein a wall that forms the third hollow layer is formed integrally and continuously with a same material as the channel wall of the branch channel that is connected to the intermediate cylinder.

3. The internal combustion engine according to claim 2, wherein the intermediate cylinder includes a plurality of intermediate cylinders whose flow channel lengths to the collective portion are different from each other;

wherein the third hollow layer includes a plurality of third hollow layers that are respectively provided for the branch channels corresponding to the plurality of intermediate cylinder, and wherein lengths of the plurality of third hollow layers in the third flow channel direction are longer in the third hollow layer corresponding to the intermediate cylinder whose flow channel length to the collective portion is longer, than in the third hollow layer corresponding to the intermediate cylinder whose flow channel length to the collective portion is shorter.

4. The internal combustion engine according to claim 2, wherein the third hollow layer covers a straight portion or a substantially straight portion of the channel wall of the branch channel that is connected to the intermediate cylinder.

5. The internal combustion engine according to claim 1, wherein the first hollow layer covers a straight portion or a substantially straight portion of the channel wall of the branch channel that is connected to the longest cylinder.

6. An internal combustion engine, comprising:

an exhaust channel that includes a manifold channel including a plurality of branch channels that are respectively connected to a plurality of cylinders and a collective portion where exhaust gases flowing through the plurality of branch channels are collected into one, and a common channel arranged on a downstream side of the collective portion; and a catalytic device that is arranged in the common channel and configured to purify the exhaust gases, wherein, with respect to a longest cylinder that is a cylinder whose flow channel length from the cylinder to the collective portion is the longest among the plurality of cylinders, the manifold channel includes a first hollow layer that covers a part or a whole of a first channel wall in a first flow channel direction of a corresponding branch channel that is connected to the longest cylinder, wherein, with respect to a shortest cylinder that is a cylinder whose flow channel length from the cylinder to the collective portion is the shortest among the plurality of cylinders and other than the longest cylinder, the manifold channel includes a second hollow layer which covers a part of a second channel wall in a second flow channel direction of a corresponding branch channel that is connected to the shortest cylinder and whose length in the second flow channel direction is shorter than that of the first hollow layer in the first flow channel direction, and wherein a wall that forms the first hollow layer is formed integrally and continuously with a same material as the first channel wall, a wall that forms the second hollow layer is formed integrally and continuously with a same material as the second channel wall, a plurality of support columns formed at predetermined intervals in the first flow channel direction connect the first channel wall and the wall that forms the first hollow layer, and a plurality of support columns formed at predetermined intervals in the second flow channel direction connect the second channel wall and the wall that forms the second hollow layer.

7. The internal combustion engine according to claim 6, wherein the plurality of cylinders includes, other than the longest cylinder and the shortest cylinder, an intermediate cylinder that is a cylinder whose flow channel length to the collective portion is shorter than that of the longest cylinder and longer than that of the shortest cylinder, wherein the manifold channel includes a third hollow layer which covers a part of a channel wall in a third flow channel direction of a corresponding branch channel that is connected to the intermediate cylinder and whose length in the third flow channel direction is shorter than that of the first hollow layer in the first flow channel direction and longer than that of the second hollow layer in the second flow channel direction, and wherein a wall that forms the third hollow layer is formed integrally and continuously with a same material as the channel wall of the branch channel that is connected to the intermediate cylinder.

8. The internal combustion engine according to claim 7, wherein the intermediate cylinder includes a plurality of intermediate cylinders whose flow channel lengths to the collective portion are different from each other;

wherein the third hollow layer includes a plurality of third hollow layers that are respectively provided for the branch channels corresponding to the plurality of intermediate cylinder, and wherein lengths of the plurality of third hollow layers in the third flow channel direction are longer in the third hollow layer corresponding to the intermediate cylinder whose flow channel length to the collective portion is longer, than in the third hollow layer corresponding to the intermediate cylinder whose flow channel length to the collective portion is shorter.

9. The internal combustion engine according to claim 7, wherein the third hollow layer covers a straight portion or a substantially straight portion of the channel wall of the branch channel that is connected to the intermediate cylinder.

10. The internal combustion engine according to claim 6, wherein the first hollow layer covers a straight portion or a substantially straight portion of the channel wall of the branch channel that is connected to the longest cylinder.

11. The internal combustion engine according to claim 6, wherein the second hollow layer covers a straight portion or a substantially straight portion of the channel wall of the branch channel that is connected to the shortest cylinder.

12. An internal combustion engine, comprising:

a cylinder head;

an exhaust channel that includes a manifold channel through which exhaust gases from a first cylinder group and a second cylinder group flow, and a common channel arranged on a downstream side of the manifold channel; and a catalytic device that is arranged in the common channel and configured to purify the exhaust gases, wherein the manifold channel includes:

a first primary manifold channel that is connected to the first cylinder group and that includes a first primary collective portion where the exhaust gases from the first cylinder group are collected into one;

a second primary manifold channel that is connected to the second cylinder group and that includes a second primary collective portion where the exhaust gases from the second cylinder group are collected into one; and a secondary manifold channel that includes a first common branch channel connected to the first primary collective portion, a second common branch channel connected to the second primary collective portion and a secondary collective portion where the first common branch channel and the second common branch channel are joined with each other, wherein the first common branch channel includes a first outer common branch channel that is arranged outside the cylinder head and that is connected to the second collective portion, wherein the second common branch channel includes a second outer common branch channel that is arranged outside the cylinder head and that is connected to the second collective portion, wherein the first outer common branch channel is longer than the second outer common branch channel, wherein the manifold channel includes a fourth hollow layer which covers a part or a whole of a fourth channel wall in a fourth flow channel direction of the first outer common branch channel, and does not include a fifth hollow layer that covers the second outer common branch channel, and wherein a wall that forms the fourth hollow layer is formed integrally and continuously with a same material as the fourth channel wall, and a plurality of support columns formed at predetermined intervals in the fourth flow channel direction connect the fourth channel wall and the wall that forms the fourth hollow layer.

13. The internal combustion engine according to claim 12, wherein the fourth hollow layer covers a straight portion or a substantially straight portion of the channel wall of the first outer common branch channel.

14. An internal combustion engine, comprising:

a cylinder head;

an exhaust channel that includes a manifold channel through which exhaust gases from a first cylinder group and a second cylinder group flow, and a common channel arranged on a downstream side of the manifold channel; and a catalytic device that is arranged in the common channel and configured to purify the exhaust gases, wherein the manifold channel includes:

a first primary manifold channel that is connected to the first cylinder group and that includes a first primary collective portion where the exhaust gases from the first cylinder group are collected into one;

a second primary manifold channel that is connected to the second cylinder group and that includes a second primary collective portion where the exhaust gases from the second cylinder group are collected into one; and a secondary manifold channel that includes a first common branch channel connected to the first primary collective portion, a second common branch channel connected to the second primary collective portion and a secondary collective portion where the first common branch channel and the second common branch channel are joined with each other, wherein the first common branch channel includes a first outer common branch channel that is arranged outside the cylinder head and that is connected to the second collective portion, wherein the second common branch channel includes a second outer common branch channel that is arranged outside the cylinder head and that is connected to the second collective portion, wherein the first outer common branch channel is longer than the second outer common branch channel, wherein the manifold channel includes:

a fourth hollow layer which covers a part or a whole of a fourth channel wall in a fourth flow channel direction of the first outer common branch channel, and a fifth hollow layer which covers a part of a fifth channel wall in a fifth flow channel direction of the second outer common branch channel, and whose length in the fifth flow channel direction is shorter than that of the fourth hollow layer in the fourth flow channel direction, and wherein a wall that forms the fourth hollow layer is formed integrally and continuously with a same material as the fourth channel wall, a wall that forms the fifth hollow layer is formed integrally and continuously with a same material as the fifth channel wall, a plurality of support columns formed at predetermined intervals in the fourth flow channel direction connect the fourth channel wall and the wall that forms the fourth hollow layer, and a plurality of support columns formed at predetermined intervals in the fifth flow channel direction connect the fifth channel wall and the wall that forms the fifth hollow layer.

15. The internal combustion engine according to claim 14, wherein the fourth hollow layer covers a straight portion or a substantially straight portion of the channel wall of the first outer common branch channel.

16. The internal combustion engine according to claim 14, wherein the fifth hollow layer covers a straight portion or a substantially straight portion of the channel wall of the second outer common branch channel.

* * * * *